United States Patent [19]

Wojcik

[11] Patent Number: 4,941,307

[45] Date of Patent: Jul. 17, 1990

[54] ZIPPER GUIDE SYSTEM FOR FORM TOOLING

[75] Inventor: John Wojcik, Des Plaines, Ill.

[73] Assignee: Zip-Pak Incorporated, Northbrokk, Ill.

[21] Appl. No.: 342,354

[22] Filed: Apr. 24, 1989

[51] Int. Cl.[5] ..... B65B 9/06; B65B 61/18; B65D 33/16

[52] U.S. Cl. ..... 53/412; 53/133; 53/450; 53/551; 383/61; 383/63

[58] Field of Search ..... 53/133, 410, 412, 450, 53/451, 550, 551, 552; 383/63, 61, 65

[56] References Cited

U.S. PATENT DOCUMENTS

| | | | |
|---|---|---|---|
| 2,362,460 | 11/1944 | Barnett | 53/412 X |
| 2,385,897 | 10/1945 | Waters | 53/551 X |
| 2,882,662 | 4/1959 | Campbell | 53/550 |
| 4,252,238 | 2/1981 | Spiegelberg et al. | 383/63 X |
| 4,428,477 | 1/1984 | Cristofolo | 206/812 X |
| 4,570,820 | 2/1986 | Murphy | 383/63 X |
| 4,625,496 | 12/1986 | Ausnit | 53/551 X |
| 4,663,915 | 5/1987 | Van Erden et al. | 53/550 X |
| 4,807,426 | 2/1989 | Smith | 53/550 |
| 4,840,012 | 6/1989 | Boeckmann | 53/412 X |

*Primary Examiner*—John Sipos
*Assistant Examiner*—Beth Bianca
*Attorney, Agent, or Firm*—Hill, Van Santen, Steadman & Simpson

[57] ABSTRACT

A method and mechanism for continuous wrapping of objects in a product package having a reclosable zipper thereon, providing a continuous sheet of thermoplastic film with a reclosable rib and groove fastener profile extending therealong parallel to the formation axis of the film with the profiles interlocked to form a flattened closure, guidingly wrapping the sheet around the object, simultaneously guiding the interlocked fastener to an upright position relative to the object, and flattening the upright interlocked profiles against an outer surface of a wall of the object and thereafter cross-sealing the film at the ends of the object locking the flattened profile to the package end.

12 Claims, 2 Drawing Sheets

ZIPPER GUIDE SYSTEM FOR FORM TOOLING

BACKGROUND OF THE INVENTION

The present invention relates to improvements in the art of wrapping objects in plastic film, and more particularly in forming a package having reclosable rib and groove interlocked plastic fasteners extending therealong.

A substantial number of developments have been made for the continuous packaging of products such as food products wherein a continuous length of film is wrapped around the package and cross-sealed to complete the closure.

One form of this type of development is known as a form, fill and seal machine, and while a substantial number of these machines operate vertically with the product dropped into the tube formed from the film, other form, fill and seal machines have been employed which operate horizontally.

To gain access to the product in the packages where the product has been wrapped by a plastic film, the film must be cut or otherwise broken open. If it is desired to replace into the opened wrapper the remainder of the product which has not been consumed, assuming the wrapper has not been destroyed in opening it, the remainder of the product must be at least partially exposed to atmosphere and subject to drying out or other deterioration due to the exposure. Because the wrapper generally snugly engages the article, it is difficult to withdraw the article from the partially ruptured wrapper so that the tendency is for the consumer to virtually destroy the wrapper to gain access to the article even though only partial use of the article is contemplated. This may require rewrapping in foil or household wrapping film in an attempt to retain freshness.

Although zipper equipped bags have been known for some time and widely used both for commercially packaged products and unfilled bags, there is need for a package which can be continuously made wherein the package is provided with a reopenable feature such as a continuous zipper along the side. Inasmuch as the zipper is openable by pulling apart on opening pull flanges, it is further desirable that a means be made so that the package is tamper-evident by requiring that the film be severed between the zipper profiles before using. This insures a hermetic seal until the product is first used and provides a means whereby the purchaser can immediately perceive whether or not the product has been tampered with or opened prior to purchase.

A further need for such product packages is that they be smooth and streamlined so that they can be stacked and handled in an easy manner. While once the package is first opened it is convenient to have the pull flanges of the zipper be upstanding, prior to the first use, it is desirable that the zipper be flat against the package so that the package has a better appearance and is easier to handle.

By way of example, U.S. Pat. No. 3,274,746 is referred to as representative of existing conventional horizontal form, fill and seal apparatus for packaging relatively heavy articles such as cheese in plastic film or the like. The method there disclosed consists in running the wrapper sheet in the form of a continuous strip along a horizontal packaging line wherein the wrapper sheet is wrapped about the product articles successively placed thereon in spaced units, by folding the sheet from opposite sides onto the articles and sealing the opposite longitudinal margins of the sheet together. Finally, the sheet which has, in effect, been sealed into a tubular envelope about the articles, is sealed across the envelope between the articles and separated into sealed individual article containing package units. This mode of packaging has been practiced for a long time without any significant change in the package in spite of the disadvantages previously mentioned.

Attention is also directed to U.S. Pat. Nos. 4,240,241 and 4,246,288 which disclose a technique for packaging according to which semi-rigid receptacles are formed in one layer of plastic web and a cover sheet is sealed marginally to each receptacle, the receptacle and the cover sheet having an interlocking rib and groove closure strip, i.e. zipper, so that when the sealed package is opened the same may be reclosed by means of the zipper. However, that technique involves a very different form, fill and seal apparatus than the virtually standard horizontal form, fill and seal machines which have long been used for sealing various food products, and in particular cheese. Therefore, in order to adopt the packaging of these two patents, the horizontal form, fill and seal machines now extensively used would have to be scrapped and the investment therein lost. The very large capital investment for installing machines adapted for producing reclosable packages according to these patents presents a formidable deterrent to their adoption.

Bags equipped with resiliently flexible zipper means have been provided for receiving various food and nonfood products and adapted for access into the tops of the bags by opening the zipper. U.S. Pat. Nos. 3,198,223 and 3,462,332 show representative structures in which the zipper profiles are extruded integrally with the bag wall material or fused with the film or bag wall material at extrusion. U.S. Pat Nos. 2,780,261, 3,054,434, 3,198,228, 3,347,298 and 3,886,633 disclose means for easy opening of the zippers externally of the bag but resistant to opening from separating forces generated as by means of the contents internally of the bag.

U.S. Pat. Nos. 3,780,781 and 3,948,705 represent structures wherein the zipper profile strips have base flanges which are fused to the bag wall film material.

U.S. Pat. No. 4,372,793 exemplifies adhesive attachment of the zipper strips to the bag film or side wall material.

U.S. Pat. Nos. 2,780,261, 2,871,539, 3,325,084, and 3,886,633 show examples of multiprofile zippers.

U.S. Pat. Nos. 3,226,787, 3,685,562, 3,827,472 and 3,625,270 disclose a tear strip structure to facilitate opening bags.

U.S. Pat. No. 4,589,145 shows another example of the formation of a flat package with a zipper opening, although the zipper projects from the side of the package.

None of the foregoing patents meet the objectives and advantages of the present invention.

An object of the present invention is to provide an improved method and apparatus for the simplified formation of continuous packages for wrapping items such as blocks of cheese or similar foodstuffs in a continuous manner wherein the package is furnished with a reopenable zipper which is carried flattened against the finished package in a manner to provide a streamlined package facilitating easy storage and handling.

A still further object of the invention is to provide an improved method and apparatus for the continual enclosure of items in film with the finished package having a reopenable zipper therealong which has tamper-evident capabilities showing the purchaser whether the package has been previously opened or not.

FEATURES OF THE INVENTION

The present invention contemplates continuously supplying a length of film along a longitudinal formation axis and wrapping the film around spaced objects. A continual seam is formed to join the edges of the film. A guide is arranged to handle a reclosable zipper midway between the edges of the film with the zipper being held upright until the package is completed guided in its upright position with a guide that insures the joining of interlocking rib and groove profiles which form the zipper. The zipper is then plowed down to a flattened position against the bag and cross-seals are made at the end holding the zipper in its flattened position to provide an efficient, streamlined package.

Other objects and advantages will become more apparent with the disclosure of the principles of the invention in connection with the teaching of the preferred embodiments thereof in the specification, claims and drawings, in which:

DESCRIPTION OF THE PREFERRED EMBODIMENT

Figure 1A:
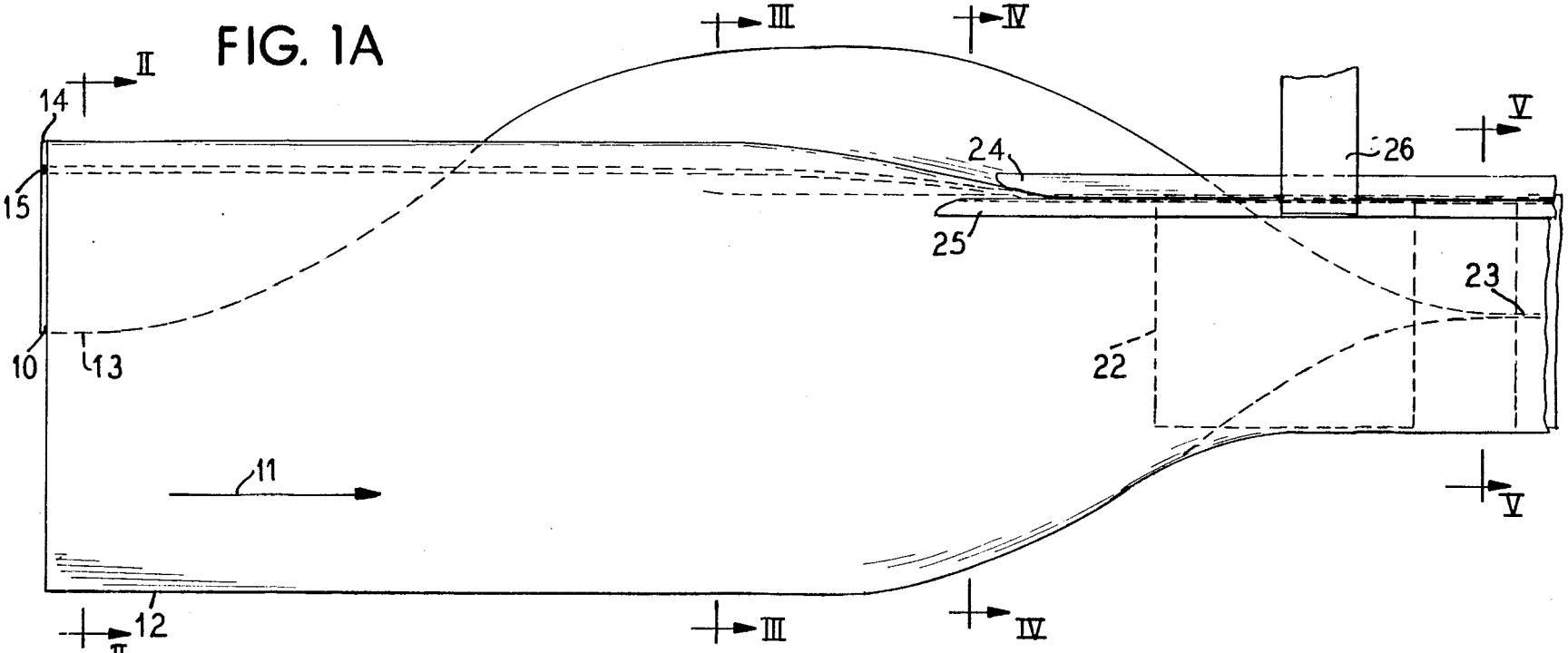
FIG. 1A is a top plan view shown in somewhat schematic form of a continuous length of film being moved forwardly along a formation axis and wrapped around spaced items.

FIG. 1A illustrates a continuous sheet of plastic film 10 being moved along a path in the direction of its formation axis as indicated by the arrowed line 11. The edges of the film shown at 12 and 13 are brought together over objects 22 which are to be wrapped. These objects can be supported in the path of the film or placed therealong as the film is moved forwardly by suitable film moving means.

Figure 2:
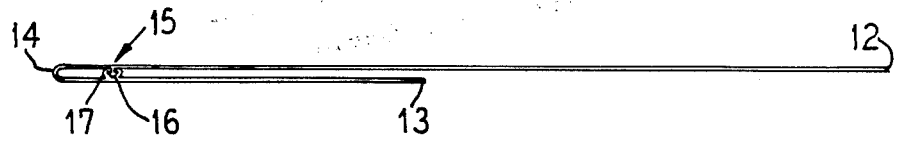
FIG. 2 is a vertical sectional line taken substantially along line II—II of FIG. 1A.

The film is doubled at a doubled edge 14 to bring together a zipper 15 which is formed of interlocking rib and groove profiles 16 and 17, FIG. 2. These profiles may take various forms as will be recognized by those versed in the art, but for purposes of simplicity, are shown as an interlocking rib and groove.

The doubled portion 14 extends above the zipper 15 so as to provide a tamper-evident protection for the bag. This also provides hermetic seals inasmuch as air cannot leak between the profiles because of the continuous fold of film at 14. When the package is eventually used, the doubled portion at 14 must be severed to provide two upstanding pull flanges which can be drawn apart to separate the rib and groove 16 and 17.

Continuing now with FIG. 1A, the edges 13 and 12 of the film are brought together to form a seam at 23 over the object 22. At the same time, the zipper and the pull flange doubled portion 14 above the zipper is plowed upwardly to an upstanding position projecting above a surface of the object 22. These plow surfaces are shown at 24 and 25 with the overall plow guide shown at 26. The position of the upstanding edge 14 is shown in FIG. 5.

Figure 3:
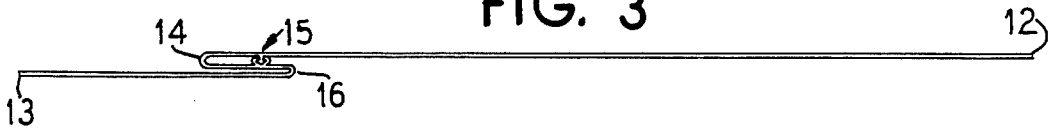
FIG. 3 is a vertical sectional line taken substantially along line III—III of FIG. 1A.
Figure 4:
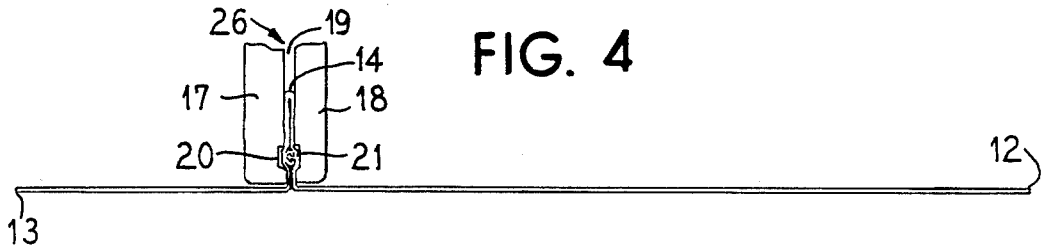
FIG. 4 is a vertical sectional view taken substantially along line IV—IV of FIG. 1A.

Prior to moving the edge 14 to an upstanding position, the edge of the film 13 is doubled back to lay the film in a flat plane as illustrated in FIG. 3. This permits the film to then be wrapped around the object as illustrated in FIG. 1A.

Figure 5:
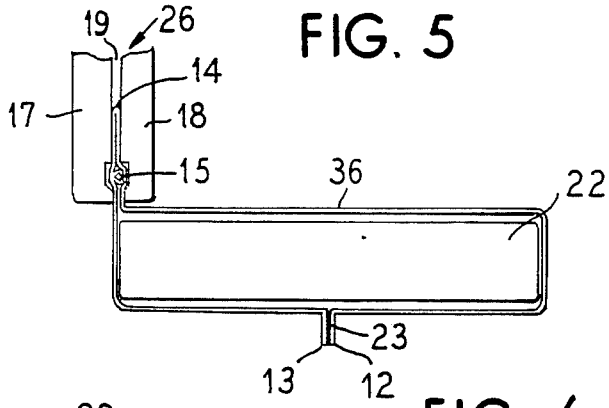
FIG. 5 is a vertical sectional view taken substantially along line V—V of FIG. 1A.
Figure 6:
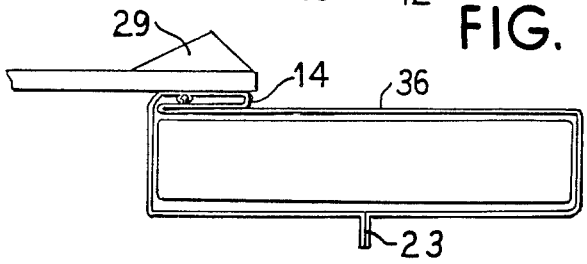
FIG. 6 is a vertical sectional view taken substantially along line VI—VI of FIG. 1B.

When the edges 12 and 13 of the film are brought together to form the seam 23, as illustrated in FIG. 5, the article 22 is enveloped with the fastener edge 14 being guided to stand erect. For this purpose, the plow guide 26 has parallel sides 17 and 18 to form a slot 19 therebetween. The slot has grooves 20 and 21 to accommodate the extra thickness of the interlocked profile zipper 15. The inner surface of the guide may be of highly polished metal or may be Teflon coated for promoting ease of sliding of the film therein.

Figure 1B:
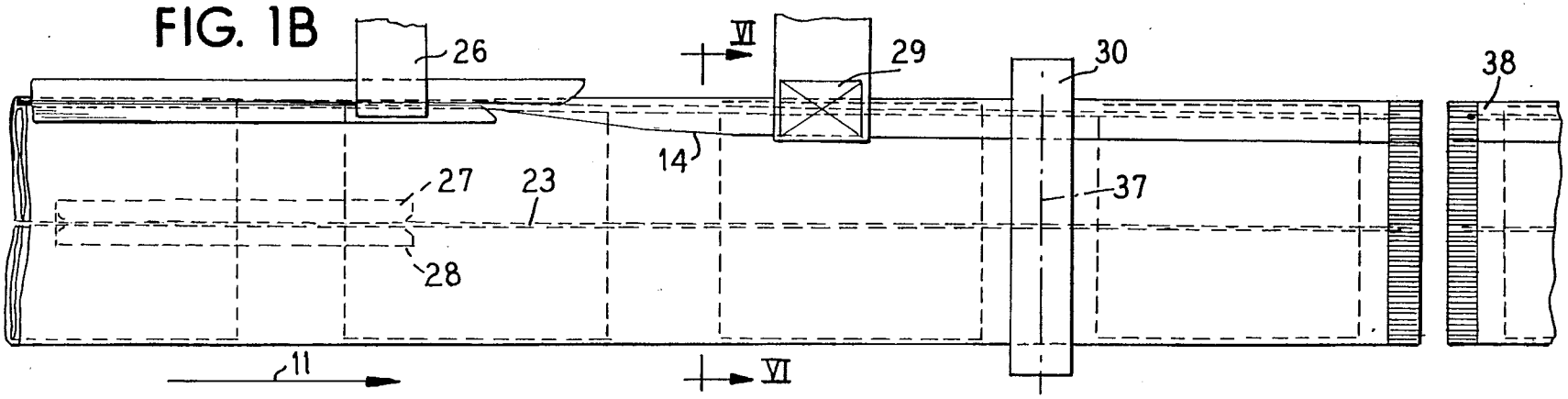
FIG. 1B is a top plan view, somewhat similar to FIG. 1A, and illustrating further steps in the operation of wrapping spaced items with spaced section lines arranged along FIGS. 1A and 1B to better illustrate the particular function performed at the station of the section line.

To complete the seam 23 therein, heated sealing bars 27 and 28, FIG. 1B, are applied. If the film is of a thermoplastic, these heated bars will melt and join the surfaces to form an airtight seam. While a heat seal bond is preferred, in some instances adhesive may be used for forming the seal of the seam 23.

Figure 7:
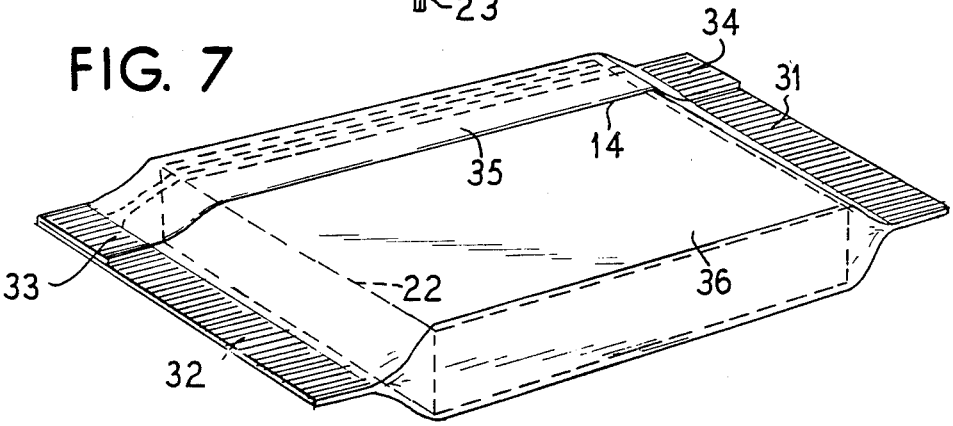
FIG. 7 is a perspective view of a finished bag completed by the method shown in the previous drawing Figures.

Following the joining of the seam 23, the upstanding doubled flange 14 is folded flat against the top surface 36 of the package. This is accomplished by a flattening plow 29 which is shaped to guide the flange 14 downwardly flat against the top of the package. The plow is arranged so that it holds the flange down against the top of the package and thereafter cross-seals are formed between objects to clamp or hold the flattened flange 14 against the package top 36. The flattened portion is shown at 35 in FIG. 7 with the ends of the flattened portion shown at 33 and 34 held at fin seals 31 and 32 at the end of the package. These fin seals are formed by heated sealing bars such as 30, FIG. 1B, applied to the packages therebetween. The sealing bars are provided with cutting means 37 to separate the packages as shown by the separated package 38 in FIG. 1B at the right side of the drawing.

Thus, it will be seen we have provided a simplified rapid way of forming packages in a continuous manner. The features of the development make it particularly attractive for commercial packaging at relatively high speeds and for the formation of a bag or package which is attractive and facilitates handling and storage. When the user wishes to open the package, he pulls the flattened portion 35, FIG. 7, upwardly, cuts the doubled edge 14 to provide upstanding pull flanges to pull the interlocked zipper portions apart for access to the bag. This enables reclosing by pressing the zipper portions together again after the desired amount of contents have been removed.

I claim as my invention:

1. The method of enclosing a product in a package having a reclosable zipper thereon, comprising the steps:

providing a continuous sheet of plastic film with reclosable rib and groove fastener profiles extending therealong parallel to the formation axis of the film with the profiles interlocked to form a flattened closure;

feeding the sheet forwardly along the formation axis and guidingly wrapping the sheet around an object to be wrapped;

simultaneously guiding the interlocked flattened closure to an upright position relative to the object;

thereafter flattening the flattened closure against the outer surface of a wall of the object;

and cross-sealing the film at the ends of the object locking the flattened profile to the package end.

2. The method of enclosing a product in a package having a reclosable zipper thereon comprising the steps of claim 1:

including pressing the interlocked fastener together to insure interlocking engagement of the profiles.

3. The method of enclosing a product in a package having a reclosable zipper thereon comprising the steps of claim 1:

wherein the film is continuous between the profile forming upstanding pull flanges.

4. The method of enclosing a product in a package having a reclosable zipper thereon comprising the steps of claim 1:

including sliding the flattened closure through a restrictive guide pressing the profiles together.

5. The method of enclosing a product in a package having a reclosable zipper thereon comprising the steps of claim 1:

including heating the edges of the film after the sheet is wrapped around the object in a continuous longitudinal seam extending parallel to the formation axis of the film.

6. The method of enclosing a product in a package having a reclosable zipper thereon comprising the steps of claim 1:

including directing the flattened closure through a guide slot to hold the flattened closure upright while the object is being wrapped and thereafter plowing the flattened closure downwardly against the surface of the object.

7. The method of enclosing a product in a package having a reclosable zipper thereon comprising the steps of claim 1:

including intermittently cross-sealing the wrapped film at each end of the object to form a closed package.

8. A mechanism for enclosing a product in a package having a reclosable zipper thereon extending continuously longitudinally parallel to the formation axis of the film, comprising in combination:

means delivering a continuous sheet of film with reclosable rib and groove fastener profiles thereon extending parallel to the formation axis of the film with the profiles interlocked to form a flattened closure;

means feeding the sheet forwardly and guidingly wrapping the sheet around an object to be wrapped;

means simultaneously guiding the interlocked fastener to an upright position relative to the object;

plow means flattening the upright interlocked profiles against the outer surface of a wall of the object;

and cross-seal bars sealing the film at the ends of the object locking the flattened profile to the package end.

9. A mechanism for enclosing a product in a package having a reclosable zipper thereon extending continuously longitudinally parallel to the formation axis of the film constructed in accordance with claim 8:

wherein the guiding means has a slot positioned at a normal angle to the object.

10. A mechanism for enclosing a product in a package having a reclosable zipper thereon extending continuously longitudinally parallel to the formation axis of the film constructed in accordance with claim 9:

wherein said slot has an enlarged portion positioned for receiving the profiles and insuring interlocking thereof.

11. A mechanism for enclosing a product in a package having a reclosable zipper thereon extending continuously longitudinally parallel to the formation axis of the film constructed in accordance with claim 8:

wherein said plow means angles downwardly against the object to press the flattened closure against the object.

12. A mechanism for enclosing a product in a package having a reclosable zipper thereon extending continuously longitudinally parallel to the formation axis of the film constructed in accordance with claim 8:

wherein said cross-sealing means is a heated bar to heat the thermoplastic of the film.

* * * * *